US008254818B2

(12) United States Patent
Chiba et al.

(10) Patent No.: US 8,254,818 B2
(45) Date of Patent: Aug. 28, 2012

(54) TRANSFER DEVICE AND IMAGE FORMING APPARATUS PROVIDED WITH THE TRANSFER DEVICE

(75) Inventors: Satoshi Chiba, Suwa (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 321 days.

(21) Appl. No.: 12/788,494

(22) Filed: May 27, 2010

(65) Prior Publication Data

US 2010/0303516 A1 Dec. 2, 2010

(30) Foreign Application Priority Data

Jun. 2, 2009 (JP) ..... 2009-133265

(51) Int. Cl.
*G03G 15/01* (2006.01)

(52) U.S. Cl. ..... 399/304; 399/121

(58) Field of Classification Search ..... 399/121, 399/304

See application file for complete search history.

(56) References Cited

U.S. PATENT DOCUMENTS

| | | | | |
|---|---|---|---|---|
| 2010/0226699 | A1* | 9/2010 | Kamijo et al. | 399/314 |
| 2010/0247172 | A1* | 9/2010 | Tanaka et al. | 399/302 |
| 2010/0247175 | A1* | 9/2010 | Tanaka | 399/313 |
| 2010/0247176 | A1* | 9/2010 | Tanaka et al. | 399/313 |
| 2010/0260512 | A1* | 10/2010 | Imamura et al. | 399/66 |
| 2010/0260522 | A1* | 10/2010 | Imamura et al. | 399/313 |

FOREIGN PATENT DOCUMENTS

| | | |
|---|---|---|
| JP | 06-274048 | 9/1994 |
| JP | 2000-238400 | 9/2000 |
| JP | 2004-271804 | 9/2004 |
| JP | 2009-014808 | 1/2009 |
| WO | 96/11426 | 4/1996 |

* cited by examiner

*Primary Examiner* — David Gray
*Assistant Examiner* — G. M. Hyder
(74) *Attorney, Agent, or Firm* — Workman Nydegger

(57) ABSTRACT

A transfer device including a transfer roller including a roller base member which opposes an image carrier carrying an image, the transfer device rotates about an axis of rotation, and has a concaved portion on an outer circumference thereof and is configured to transfer the image carried by the image carrier to a recording medium when the concaved portion is not opposed to the image carrier, the device also including a pressing portion configured to press the transfer roller to the image carrier, and a contact portion provided at either end of the transfer roller, wherein the contact portion includes an outer circumference which comes into contact with a supporting portion disposed on a drive transmitting portion configured to transmit a drive to the image carrier while the concaved portion opposes the image carrier, and an elastic member is provided on the outer circumference of the contact portion.

16 Claims, 6 Drawing Sheets

IIIA-2
IIIB-2
D4
W41
Wnp
NP
A34
A32
X
4
41
42
43
44
46
47
51
31
32
34
321
322
341
342
421
422
422a
441
442
471
472
473
A4

TRANSFER DEVICE AND IMAGE FORMING APPARATUS PROVIDED WITH THE TRANSFER DEVICE

The entire disclosures of Japanese Patent Application No. 2009-133265, filed Jun. 2, 2009 is expressly incorporated herein by reference.

BACKGROUND OF THE INVENTION

1. Technical Field

The present invention relates to a transfer device configured to transfer an image formed on an image carrier to a recording medium and an image forming apparatus provided with the device.

2. Related Art

Image forming apparatuses which develop and form electrostatic latent images using a high-viscosity liquid developer including toner formed of solid component dispersed in carrier liquid, are currently known in the art. One example of one of these image forming apparatuses is in FIG. 1 of Japanese Patent Document No. JP-A-2009-14808.

In the '808 image forming apparatus, four image forming stations configured to form images of different colors are provided and are used to form toner images which are superimposed on an intermediate transfer belt, thereby forming a multi-color image on the intermediate transfer belt. The intermediate transfer belt is extended between a pair of drive roller and a driven roller which are disposed apart from each other. The intermediate transfer belt is rotated in a predetermined direction while carrying the color image by driving the drive roller using a belt drive motor. A transfer device often used in a so-called dry image forming apparatus is provided so as to oppose the drive roller, and the color image is secondarily transferred to the recording medium, which may comprise a variety of different types of media, including as sheets of paper, films, cloths, and so on. In other words, a secondary transfer roller covered with an elastic member such as rubber over an outer circumference thereof is disposed at a secondary transfer position so as to oppose the drive roller with the intermediate transfer belt being disposed between the secondary transfer roller and the drive roller, thereby forming a nipping area with respect to the intermediate transfer belt.

Then, by driving the drive roller using the belt drive motor, the intermediate transfer belt is rotated by the intermediate transfer belt and the secondary transfer roller is driven and rotated, causing the recording medium to be pinched and transported at the nipping area. During the transportation in the nipping point, the color image formed on the intermediate transfer belt is secondarily transferred to the recording medium.

Additional examples of apparatuses known in the art are illustrated in FIG. 1 of JP-A-2009-14808 and FIG. 1 of JP-A-2000-238400.

Since the apparatus disclosed in JP-A-2009-14808 employs a wet system using the liquid developer, difficulties may arise when the recording medium which has passed through the nipping point and is being transported toward the image forming station because the recording medium may become stuck to the surface of the intermediate transfer belt, resulting in a paper jam. In order to solve this problem, usage of a transfer device such as those currently employed in a stencil printing apparatus has been proposed.

More particularly, in the stencil printing apparatus, such as the apparatus described in JP-A-2000-238400, an impression cylinder having a sheet clamper for holding a leading end of the sheet is provided as the transfer device. In other words, the impression cylinder (corresponding to "transfer roller" of the invention) is registered at a fixed position with respect to a cylinder on which a pressed master is wound. Then, the impression cylinder is rotated by a drive force provided from a driving portion such as a motor while pinching the leading end of the sheet by the sheet clamper, so that ink printing may be performed.

Thus, using the sheet clamper, the printed sheet is not stuck to the cylinder and is reliably separated from the cylinder on the downstream side of the pressed position even though high-viscosity ink is used. Because this system works reliably for an stencil printing apparatus, attempts have been made to configure the secondary transfer roller in the same manner as the impression cylinder, that is, to provide the secondary transfer roller with a gripping portion which may be used to grip the recording medium on the secondary transfer roller. In other words, by driving the secondary transfer roller while gripping the leading end (non-image portion) of the recording medium with the gripping portion, the recording medium having passed through the nipping point is separated desirably from the intermediate transfer belt, and paper jams can be effectively prevented.

However, when diverting the transfer device disclosed in JP-A-2000-238400 to the image forming apparatus, two points are needed to be taken into consideration and, consequently, load variations might become a serious problem. The first point to be considered is a contact system of the secondary transfer roller with respect to the intermediate transfer belt. In other words, in the image forming apparatus of this type, the transfer process is performed by pressing the secondary transfer roller toward the intermediate transfer belt such that the secondary transfer roller is in contact with the intermediate transfer belt via the recording medium with a constant load being applied. It is important that the load applied remain constant in order to transfer the images desirably to the recording media having various thicknesses. Therefore, it is necessary that a constant load system is used when diverting the transfer device disclosed in JP-A-2000-238400.

The second point is that it is necessary to provide a concaved portion on the outer periphery of the secondary transfer roller and dispose the gripping portion in the concaved portion. In other words, while the concaved portion opposes the intermediate transfer belt, the recording medium is needed to be gripped in a state in which the outer circumference of the secondary transfer roller is kept separate from the surface of the intermediate transfer belt.

Then, when the concaved portion does not oppose the intermediate transfer belt, that is, when the outer circumference of the secondary transfer roller opposes the surface of the intermediate transfer belt and forms the nipping point, the toner image carried on the intermediate transfer belt is transferred to the recording medium.

In this manner, although a period in which the outer periphery of the secondary transfer roller opposes the intermediate transfer belt (contact period) and a period in which they are separated (separation period) are mixed while the secondary transfer roller makes one turn, the secondary transfer roller is pressed toward the intermediate transfer belt. Therefore, the load applied on the intermediate transfer belt may vary significantly when the contact period is switched to the separation period or vice versa. In particular, in the stencil printing apparatus disclosed in JP-A-2000-238400, since the printing is performed using the master which has been pressed in advance, the variation of the load does not cause a serious problem. In the image forming apparatus, however, lowering of the image quality due to the load variations may occur. In other words, in the image forming apparatus, image forming processes such as formation of a latent image, development, and a primary transfer of the toner image is needed to be performed in parallel with the rotation of the secondary transfer roller.

As a consequence of the load variations which may occur during the image forming processes, problems such as fluctuations in the latent image at the latent image forming position (exposing portion) or fluctuations in the primarily transferred toner image. These fluctuations may lower the image quality.

SUMMARY

An advantage of some aspects of the invention is to provide a transfer device configured to transfer an image carried on an image carrier to a recording medium using a transfer roller having a concaved portion on the outer circumference thereof and an image forming apparatus provided with the device capable of restraining load variations generated at the time of transfer.

A first aspect of the invention is a transfer device including a transfer roller including a roller base member opposing an image carrier for carrying an image which rotating about an axis of rotation, having a concaved portion on an outer circumference thereof, and being configured to transfer the image carried by the image carrier to a recording medium while the concaved portion does not oppose the image carrier, a pressing portion configured to press the transfer roller to the image carrier, a supporting portion disposed on a drive transmitting portion configured to transmit a drive to the image carrier when the concaved portion opposes the image carrier, and a contact portion provided at end of the roller base member in the direction of the axis of rotation at a position corresponding to the concaved portion, the contact portion including an outer circumference which comes into contact with the supporting portion, the outer circumference of the contact member also having an elastic member formed therein.

Another aspect of the invention is an image forming apparatus including an image forming portion configured to form an image, an image carrier configured to carry the image formed by the image forming portion, a driving portion configured to drive the image carrier, a drive transmitting portion configured to transmit a drive from the driving portion, a supporting portion disposed on the drive transmitting portion, and a transfer portion configured to transfer the image carried by the image carrier to a recording medium, wherein the transfer portion includes: a transfer roller including a roller base member opposing the image carrier, rotating about an axis of rotation, and having a concaved portion on an outer circumference thereof, and being configured to perform the transfer while the concaved portion does not oppose the image carrier, a pressing portion configured to press the transfer roller to the image carrier, and a contact portion provided at a position corresponding to the concaved portion in the direction of the revolving shaft, the contact portion includes an outer circumference which comes into contact with a supporting portion while the concaved portion opposes the image carrier, and an elastic member is provided on the outer circumference of the contact portion.

In the transfer device and the image forming apparatus described above, the transfer roller rotates about the revolving shaft while being pressed by the pressing portion against the image carrier, and the period in which the concaved portion opposes the image carrier, referred to as the opposed period, and the period in which the same is not opposed, referred to as the non-opposed period are switched alternately. In the non-opposed period in which the concaved portion does not oppose the image carrier, the outer circumference of the transfer roller opposes the image carrier and a nipping point is formed between the transfer roller and the image carrier. Then, by causing the recording medium to pass through the nipping point, the image carried by the image carrier is transferred to the recording medium. In this manner, a predetermined load is applied on the image carrier in this period. In contrast, in the opposed period in which the concaved portion opposes the image carrier, the outer circumference of the transfer roller is separated from the image carrier, and the load is eliminated, but an elastic member provided on the outer circumference of the contact portion comes into contact with the supporting portion disposed on the drive transmitting portion which transmits the drive to the image carrier, whereby another load is applied on the image carrier. Therefore, the difference between the load applied on the image carrier during the opposed period and the load applied on the image carrier during the non-opposed period may be restrained. In addition, an impact at the time of switching between the opposed period and the non-opposed period is absorbed by an elastic force of the elastic member. In this manner, the switching is desirably achieved while restraining the load variations.

BRIEF DESCRIPTION OF THE DRAWINGS

The invention will be described with reference to the accompanying drawings where like numbers reference like elements.

DESCRIPTION OF EXEMPLARY EMBODIMENTS

Figure 1:
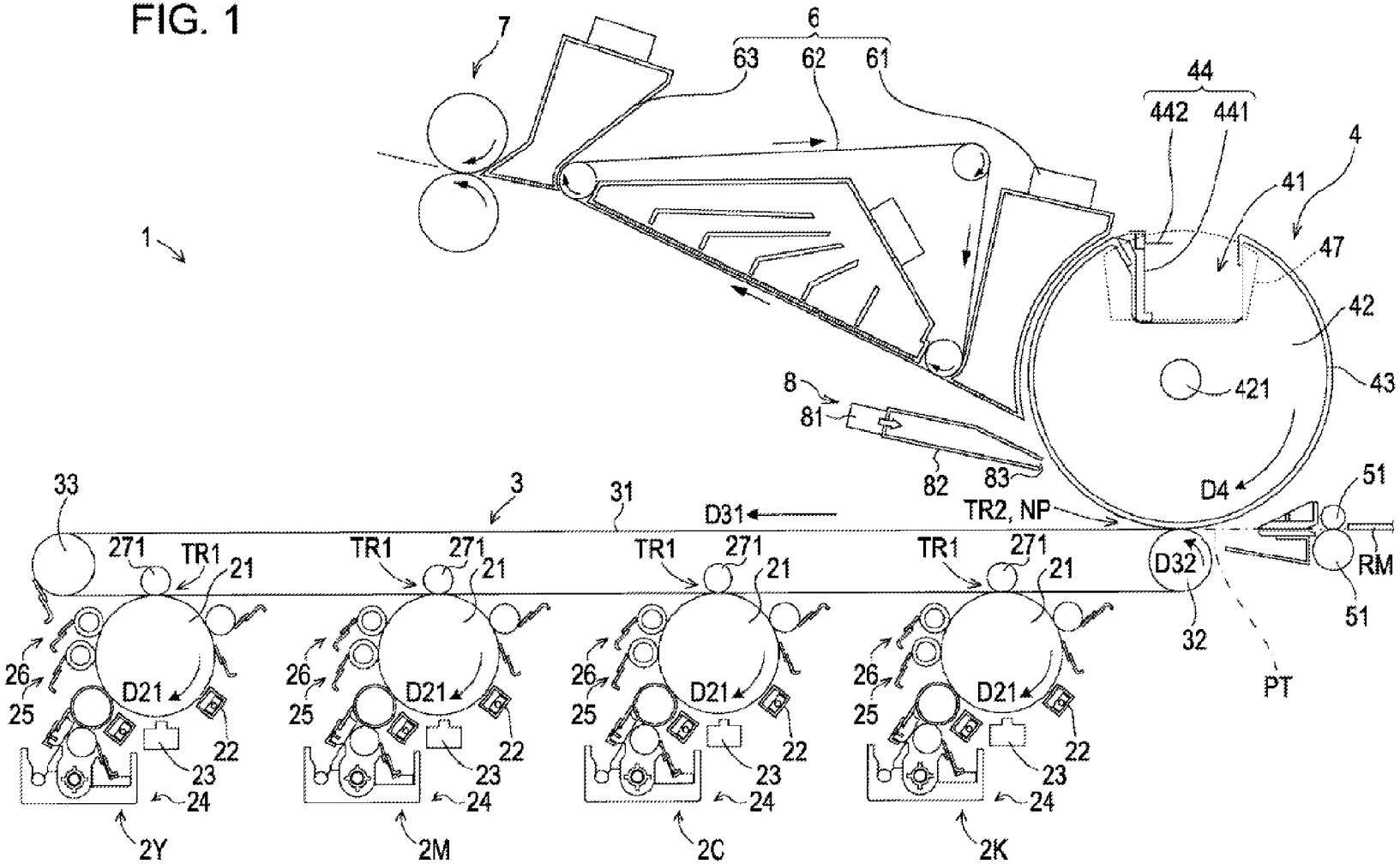
FIG. 1 is a drawing showing an image forming apparatus provided with an embodiment of a transfer device according to the invention.

FIG. 1 is a drawing showing an image forming apparatus provided with an embodiment of a transfer device according to the invention. An image forming apparatus 1 includes four image forming stations: a yellow image forming station 2Y, a magenta image forming station 2M, a cyan image forming station 2C, and a black image forming station 2K, each of which forms a plurality of images in their respective colors. The image forming apparatus 1 is capable of being selectively operated in a color mode in which four colors of toner of yellow (Y), magenta (M), cyan (C), and black (K), are overlapped to form a color image and in a monochrome mode in which only black (K) toner is used to form a monochrome image. In this image forming apparatus, when an image forming command is given to a controller (not shown) having a CPU or a memory from an external device such as a host computer, the controller controls respective portions of the device and performs a predetermined image forming action, whereby an image corresponding to the image forming command is formed on a sheet-shaped recording medium RM such as copy paper, transfer paper, sheet, and OHP transparent sheet.

The respective image forming stations 2Y, 2M, 2C, and 2K are provided with photoconductor drums 21 on which toner images of the respective colors are formed on the surfaces thereof. The respective photoconductor drums 21 are arranged in such a manner that revolving shafts thereof are arranged in parallel to or substantially parallel to a primary scanning direction (the direction vertical to a paper plane of FIG. 1), and are driven to rotate at a predetermined velocity in the direction indicted by an arrow D21 in FIG. 1.

Around the each photoconductor drum 21, a charger 22, such as a corona charger, is configured to charge the surface of the photoconductor drum 21 to a predetermined potential. An exposure unit 23 is configured to expose the surface of the photoconductor drum 21 according to an image signal to form an electrostatic latent image. A developing unit 24 is also configured to visualize the electrostatic latent image as a toner image. In addition to these components, a first squeezing portion 25, a second squeezing portion 26, a primary transfer unit configured to primarily transfer the toner image to an intermediate transfer belt 31 of a transfer unit 3, a cleaning unit configured to perform cleaning of the surface of the photoconductor drum 21 after the transfer, and a cleaner blade are also disposed around the photoconductor drum 21 in the recited order along a direction of rotation D21 of the photoconductor drum 21, clockwise in FIG. 1.

The charger 22 does not come into contact with the surface of the photoconductor drum 21, and a corona charger conventionally used in the related art may be used as the charger 22. When a scorotron charger is used as the corona charger, a positive wire current is flowed in a charge wire of the scorotron charger, and a DC grid charge bias is applied on a grid. By the photoconductor drum 21 charged with corona discharge by the charger 22, the potential of the surface of the photoconductor drum 21 is set to a substantially uniform potential.

The exposure unit 23 exposes the surface of the photoconductor drum 21 using a light beam according to an image signal supplied from the external device, causing an exposed electrostatic latent image corresponding to the image signal to be formed. The exposure unit 23 may be configured to scan a light beam from a semiconductor laser by a polygon mirror or may be composed of line head or the like having light emitting elements arranged in the primary scanning direction.

Toner is supplied from the developing unit 24 to the exposed electrostatic latent image, and the electrostatic latent image is developed by the toner. In the developing unit 24 of the image forming apparatus 1, toner development is performed using liquid developer containing substantially 20% weight ratio of toner dispersed in carrier liquid. In this embodiment, a high viscosity liquid developer (on the order of 30 to 10000 pa·s) obtained by adding solid material of about 1 μm in average particle diameter including a coloring agent such as pigment dispersed to a high concentration and high viscosity resin having non-volatility at room temperatures into a liquid solvent such as organic solvent, silicon oil, mineral oil, or edible oil together with a dispersing agent to have a toner solid content concentration of about 20% is used as the carrier liquid instead of low concentration (1 to 2 wt %) and low viscosity volatile liquid developer having volatility at room temperatures and containing Isoper (Trade Mark: Exxson).

The first squeezing portion 25 is arranged on the downstream side of a developing position in the direction of rotation D21 of the photoconductor drum 21, and the second squeezing portion 26 is arranged on the downstream side of the first squeezing portion 25. Squeeze rollers are provided at these squeezing portions 25 and 26 respectively. The respective squeezing rollers come into contact with the surface of the photoconductor drum 21 to remove excessive carrier liquid or fogged toner of the toner image. Although the excessive carrier liquid and fogged toner are removed by the two squeezing portions 25 and 26 in this embodiment, the number and arrangement of the squeezing portions are not limited thereto and, for example, arrangement of only one squeezing portion may also be used.

The toner image having passed through the squeezing portions 25 and 26 is primarily transferred to the intermediate transfer belt 31 by the primary transfer unit. The intermediate transfer belt 31 is extended between a pair of belt transfer rollers 32 and 33 disposed apart from each other, and is brought into an orbital rotation in a predetermined direction D31 by driving the roller by a belt drive motor. More specifically, the right side roller 32 of these belt transfer rollers 32 and 33 in FIG. 1 is a drive roller, and the belt drive motor is mechanically connected to the drive roller 32.

In this embodiment, a driver (not shown) is provided for driving the belt drive motor, which outputs a drive signal according to a command pulse provided from a controller to the belt drive motor and controls the position. Accordingly, the drive roller (belt transfer roller) 32 rotates in a direction D32 indicated by the arrow in FIG. 1 at a peripheral velocity corresponding to the command pulse, and the surface of the intermediate transfer belt 31 performs an orbital movement in the direction D31 at a constant velocity. In this manner, in this embodiment, the drive roller 32 transmits the drive from the belt drive motor to the intermediate transfer belt 31. As such, the drive roller 32 comprises a drive transmitting portion as recited in the claims below.

The primary transfer unit includes a backup roller 271, and the backup roller 271 is disposed so as to oppose the photoconductor drum 21 with the intermediary of the intermediate transfer belt 31 at a primary transfer position TR1, and transfers the toner image on the photoconductor drum 21 to the intermediate transfer belt 31. Then, by performing transfer of the toner images by the respective transfer units 27, the toner images of the respective colors on the photoconductor drums 21 are superimposed on the intermediate transfer belt 31 in sequence, so that a full color toner image is formed. In this manner, in this embodiment, the intermediate transfer belt 31 configured as described above comprises the image carrier of the claimed invention.

The toner image transferred to the intermediate transfer belt 31 is transported to a secondary transfer position TR2 as shown in FIG. 1. The transfer device according to the invention is arranged at the secondary transfer position TR2. In other words, a secondary transfer roller 4 of the transfer device (comprising the transfer portion of the claimed invention) is disposed so as to oppose the drive roller 32 of the transfer unit 3 with the intermediary of the intermediate transfer belt 31 wound around the drive roller 32.

Then, at the secondary transfer position TR2, a single color or a plurality of colors of toner images formed on the intermediate transfer belt 31 are transferred to the recording medium RM transported from a pair of gate rollers 51 and 51 along a transporting path PT. In this embodiment, since the toner image is formed by a wet developing system in which the toner image is formed by using the liquid developer, the secondary transfer roller 4 having a griping portion is used which will be described more fully below.

The recording medium RM on which the toner image is secondarily transferred is fed from the secondary transfer roller 4 to a transporting mechanism 6 along the transporting path PT. In the transporting mechanism 6, a first sucking portion 61, a transfer material transporting portion 62, and a second sucking portion 63 are arranged in sequence along the transporting path PT, and these members work in association to transport the recording medium RM to a fixing unit 7.

When the recording medium RM having the toner image secondarily transferred thereto is sent to the transporting mechanism 6, in order to ensure feeding of the recording medium RM to the first sucking portion 61 and prevent the image from becoming dirty, a blowing unit 8 is arranged so as to oppose the secondary transfer roller 4 between the secondary transfer position TR2 and the first sucking portion 61 in this embodiment. The blowing unit 8 blows out air from an opening 83 of a case portion 82 generating in association with the operation of an airflow generating portion 81 in the direction indicated by a hollow arrow, so that air is blown onto a leading end of the recording medium RM as it is released from being gripped by a gripping portion 44 of the secondary transfer roller 4, which is described more fully below. Hence the leading end is pressed away from the secondary transfer roller 4 by a projecting claw (not shown).

In this manner, the leading end of the recording medium RM is fed toward the first sucking portion 61. Also, by the air blown onto the recording medium RM, a trailing end of the recording medium RM is prevented from coming into contact with the intermediate transfer belt 31 and hence making the image dirty when the trailing end is discharged from the secondary transfer position TR2. In the case where the recording medium RM has a low elastic restoring force and low elasticity, the blowing of air by the blowing unit 8 may be omitted.

Furthermore, the fixing unit 7 is disposed on the downstream side of the transporting path PT, that is, on the opposite side of the transporting mechanism 6 from the secondary transfer roller 4, which is shown as the left side in FIG. 1, and heat or pressure is applied on the toner image of monochrome or a plurality of colors transferred to the recording medium RM, whereby fixation of the toner image to the recording medium RM is performed.

Figure 2A:
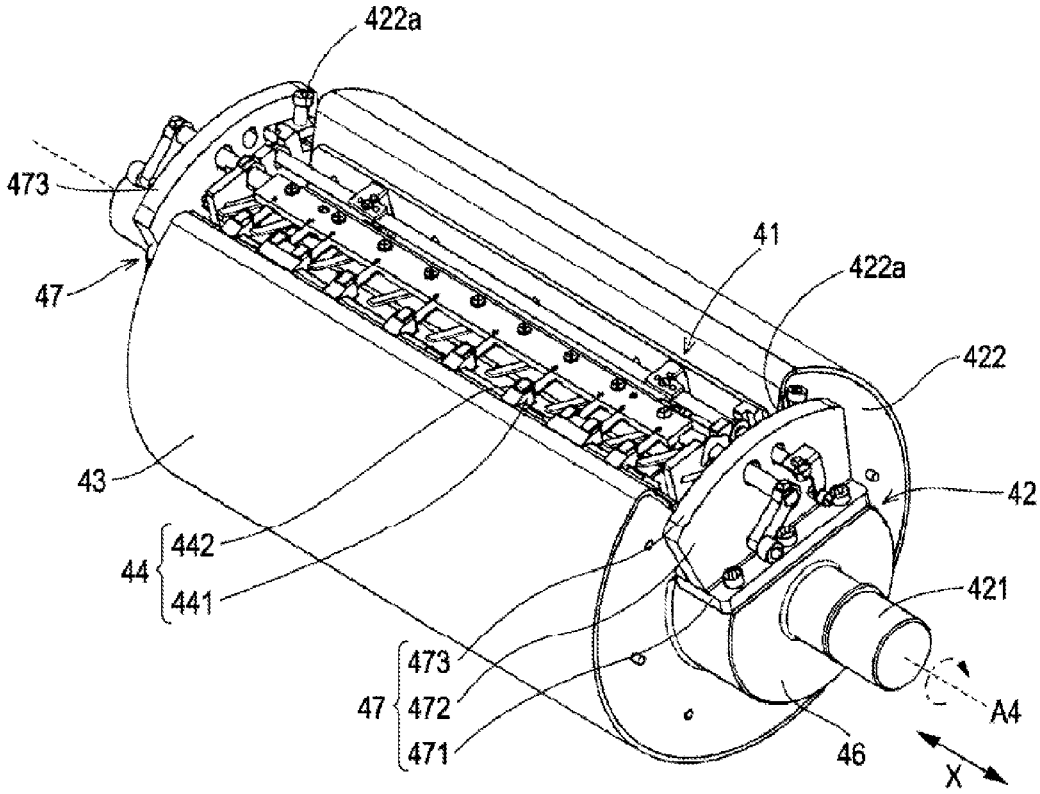
FIG. 2A is a drawing showing the embodiment of the transfer device according to the invention.
Figure 2B:
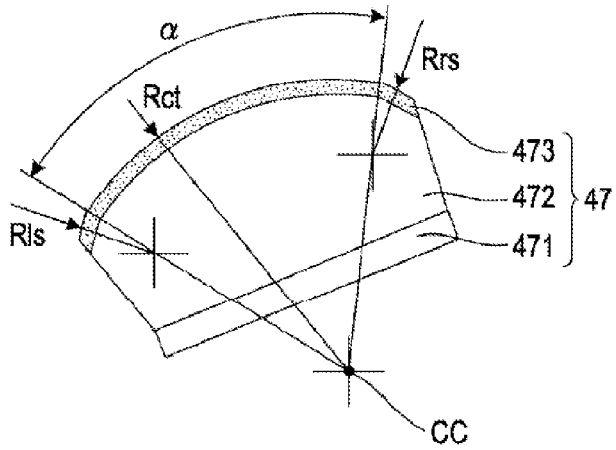
FIG. 2B is a drawing showing the embodiment of the transfer device according to the invention.
Figures 3A, 3B, 3C, 3D:
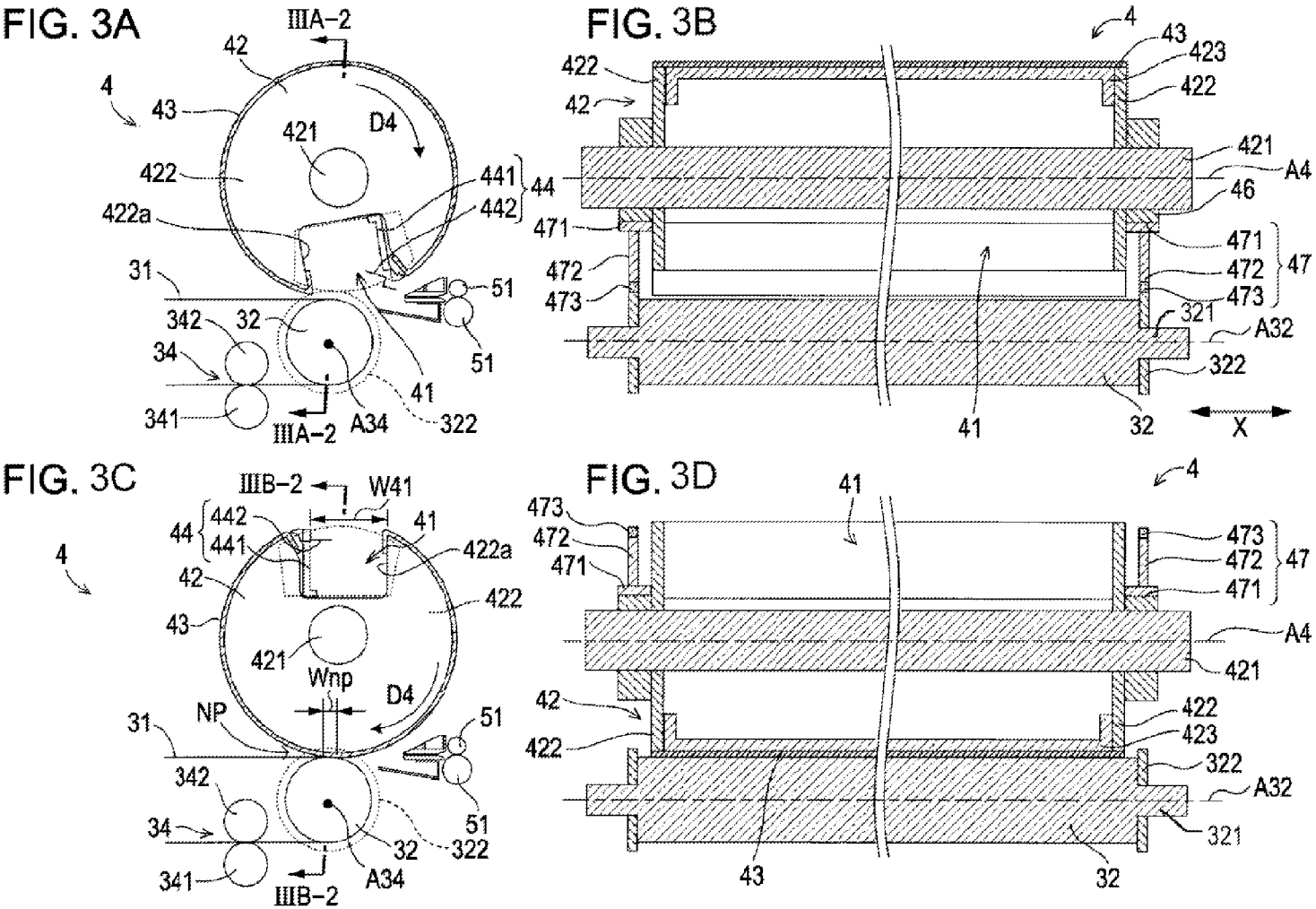
FIG. 3A to 3D are drawings showing a relationship among a secondary transfer roller, a intermediate transfer belt, and a drive roller.

FIGS. 2A and 2B are drawings showing an embodiment of the transfer device according to the invention. FIG. 2A is a perspective view showing an entire configuration of the transfer device. FIG. 2B is a side view showing the shape of an angular contact unit which corresponds to a "contact portion" of the invention. FIG. 3A is a side view showing a relationship among the secondary transfer roller, the intermediate transfer belt, and the drive roller, in a case where the concaved portion opposes the drive roller. FIG. 3B is a cross-sectional view taken along the line IIIA-2-IIIA-2 in FIG. 3A. FIG. 3C is a side view of the same in a case where a nipping point is formed, and FIG. 3D is a cross-sectional view taken along the line IIIB-2-IIIB-2 in FIG. 3C.

As shown in these drawings, the secondary transfer roller 4 includes a roller base member 42. The roller base member 42 is rotatable about an axis of rotation A4 extending in the X direction. A concaved portion 41 is provided on the outer circumference of the base member 42. As shown in FIGS. 3A-3D, the roller base member 42 is arranged in such a manner that the axis of rotation A4 extends in parallel or in substantially parallel to an axis of rotation A32 of the drive roller (belt transfer roller) 32, and side panels 422 and 422 are attached on both ends of a revolving shaft 421. More specifically, the side panels 422 and 422 each comprise a disk-shaped metallic plate having a notched portion 422*a* formed thereon, and the notched portion 422*a* has a substantially rectangular shape in side view, as shown in FIGS. 3A and 3C. Then, as shown in FIGS. 2A and 2B, the notched portions 422*a* are each attached to the revolving shaft 421 at either end of the base member 42, with a distance which is slightly longer than the width of the intermediate transfer belt 31 being between the them. A metallic plate 423 is arranged so as to bridge the span between the peripheral edges of the both side panels 422 over the entire length of the base member 42, and peripheral edge portions of the metallic plate 423 are joined to inner surfaces of the both side panels 422. In this manner, the roller base member 42 having a drum shape as a whole, and including the concaved portion 41 on part of the outer circumference so as to extend in parallel or in substantially parallel to the revolving shaft 421 is formed.

In addition, an elastic sheet 43 such as rubber or resin is formed on the outer circumference of the roller base member 42, that is, on the surface area of the metallic plate except at the area corresponding to the interior of the concaved portion 41. The elastic sheet 43 opposes the intermediate transfer belt 31 wound around the drive roller 32, which is described more fully below, and forms a nipping point NP.

The gripping portion 44 for gripping the recording medium RM is disposed in the interior of the concaved portion 41. The gripping portion 44 includes a gripper supporting member 441 provided so as to extend upright from an inner bottom portion of the concaved portion 41 to the outer circumference of the roller base member 42, and a gripper member 442 supported so as to come into and out of contact with the distal end of the gripper supporting member 441. The gripper member 442 is connected to the gripper drive portion (not shown). Then, by the operation of the gripper drive portion upon receipt of an release command from the controller, the distal end of the gripper member 442 is separated from the distal end of the gripper supporting member 441 gripping the recording medium RM causing the supporting member 441 and the gripper member 442 to release the grip. In contrast, by the operation of the gripper drive portion upon receipt of the grip command from the controller, the distal end of the gripper member 442 is moved to the distal end of the gripper supporting member 441, causing the gripper supporting member 441 and the gripper member 442 to grip the recording medium RM. The configuration of the gripping portion 44 is not limited to this embodiment and, for example, other gripping mechanisms known in the related art, such as the mechanism disclosed in JP-A-2000-238400 may be employed.

Supporting members 46 are attached to the outside surfaces of the respective side panels 422 on both sides in a direction of axis of rotation X, that is, at both ends of the revolving shaft 421 so as to be rotatable integrally with the roller base member 42. The supporting members 46 each include a planer area 461 corresponding to the concaved portion 41. Then, the transfer roller side angular contact units (or contact portions) 47 are attached respectively to the planar areas 461. Each angular contact unit 47 is configured in such a manner that a base portion 471 is attached to the supporting member 46, and the portion from the base portion 471 to an angular contact portion 472 extends in the normal direction of the planar area 461, and the distal end of the angular contact portion 472 extends to a position in the vicinity of the end of the concaved portion 41 on the opening side.

In other words, as shown in FIG. 2A, when viewing the roller base member 42 from the end of the revolving shaft 421, the angular contact units 47 are arranged so as to close the concaved portion 41.

Elastic members 473 are attached to the outer circumference of the distal end of the angular contact portions 472. As shown in FIG. 2B, the elastic member 473 is formed so as to have a curvature Rct at the center portion of the outer circumference on the distal end side which is larger than the curvatures Rrs, Rls at the both ends. For example, in this embodiment, the outer diameter of the roller of the roller base member 42 including the elastic sheet 43 is set to approximately 191 mm, while the curvature Rct is set to 88.2 mm, and the curvatures Rrs and Rls at the both ends are set to 22.4 mm. A center of curvature CC at the center portion of the each elastic member 473 is arranged at the axis of rotation of the roller base member 42, that is, the center axis of the revolving shaft 421, and an angular range α at the center portion is set to be 63° which is slightly wider than the range of opening (60°) of the concaved portion 41.

Therefore, as described later, when the secondary transfer roller 4 is rotated, the concaved portion 41 opposes the intermediate transfer belt 31 wound around the drive roller 32 across the angular range α. Also, a length of the opening (opening width) W41 of the concaved portion 41 along a direction of rotation D4 of the roller base member 42 is:

$$191\times\pi\times(60/360)\approx100 \text{ mm}.$$

In contrast, in an angular range β (=360°−60°), the elastic sheet 43 opposes the intermediate transfer belt 31 to form the nipping point NP as described below, and the length of the elastic sheet 43 along the direction of rotation D4 of the roller base member 42 is set to:

$$191\times\pi\times(300/360)\approx500 \text{ mm}.$$

In this embodiment, a length of the nipping point NP (nip width) Wnp along the direction of rotation D4 of the roller base member 42 is on the order of 11 mm, and has a relation:

(opening width *W*41 of concaved portion 41)>(nip width *Wnp* at nip NP).

The secondary transfer roller 4 configured in this manner is arranged such that the revolving shaft 421 extends in parallel or in substantially parallel to the axis of rotation A32 of the drive roller 32, and is urged toward the drive roller 32 side by a pressing portion, not shown. Therefore, in the angular range β, 300° in this embodiment, as shown in FIGS. 3C and 3D, the elastic sheet 43 is pressed against the intermediate transfer belt 31 wound around the drive roller 32 and the nipping point NP is formed. In this embodiment, annular angular contact members 322 are attached to the both ends of a revolving shaft 321 of the drive roller 32, and the outer diameter is set to be larger than the value of [(thickness of intermediate transfer belt 31)×2+(outer diameter of drive roller 32)]. Therefore, in the angular range α, as shown in FIGS. 3A and 3B, the center portions of the elastic members 473 of the angular contact units 47 on the transfer roller side come into contact with the drive roller side angular contact members 322, which correspond to "supporting portion" of the invention, and come into contact with the drive roller 32 via the drive roller side angular contact members 322. However, in the embodiment, a relationship of:

$$\alpha+\beta>360°$$

is established as described above, and the transfer device is configured in such a manner that the angular ranges α, β overlap with each other as described below.

Figure 4:
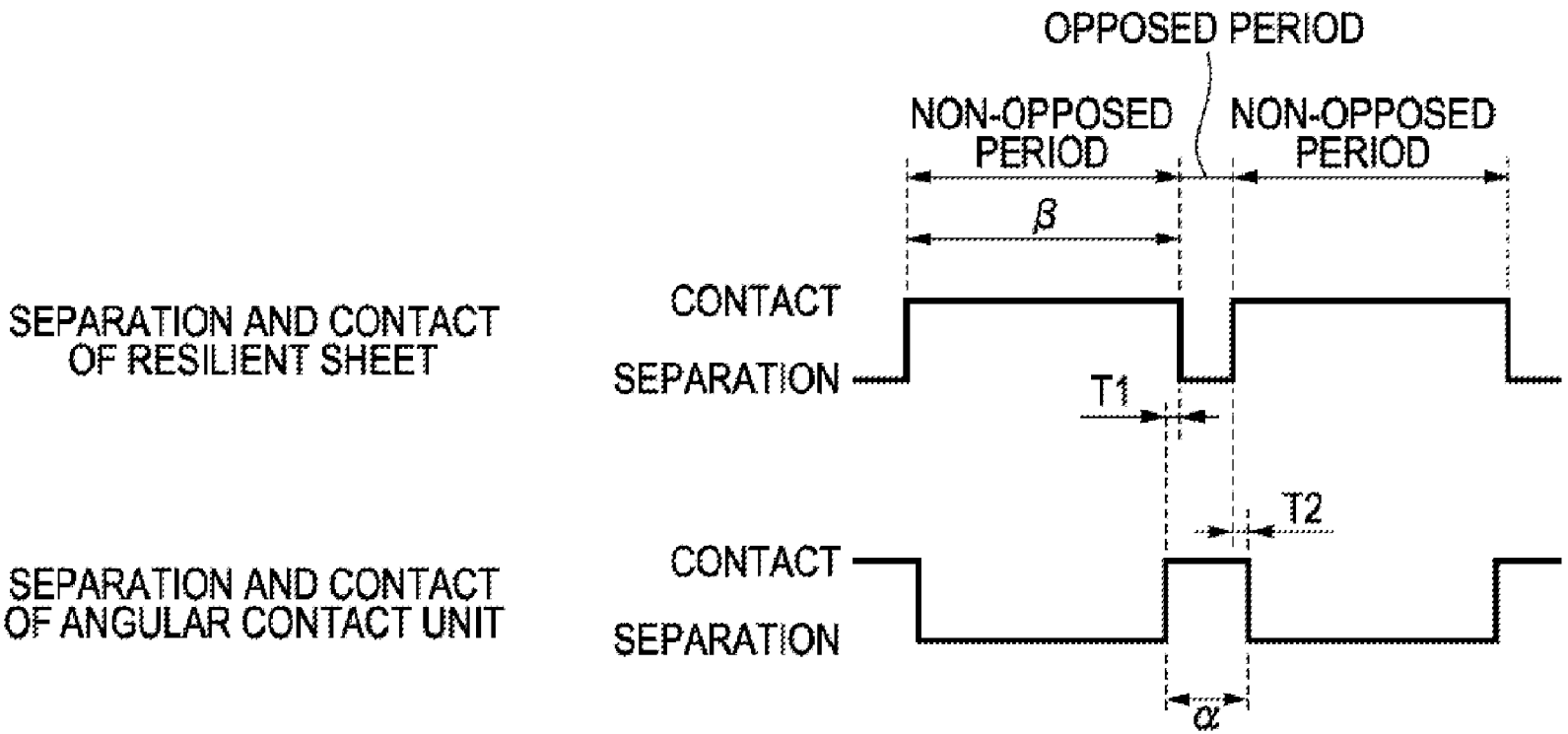
FIG. 4 is a timing chart showing separation and contact actions of an elastic sheet and separation and contact actions of angular contact units.

FIG. 4 is a timing chart showing separation and contact actions of an elastic sheet and separation and contact actions of an angular contact unit. In this embodiment, as shown in FIG. 4, the period in which the concaved portion 41 opposes the intermediate transfer belt 31, referred to as an opposed period, and the period in which it does not oppose the intermediate transfer belt 31, referred to as a non-opposed period, are switched alternately, and the elastic sheet 43 repeats separation and contact with the intermediate transfer belt 31.

In other words, while the concaved portion 41 is away from the intermediate transfer belt 31 in the non-opposed period, the elastic sheet 43 comes into contact with the intermediate transfer belt 31 to form the nipping point NP, so that the secondary transfer is enabled. Then, the elastic sheet 43 starts to separate from the intermediate transfer belt 31 by the rotation of the secondary transfer roller 4. In this embodiment, the elastic members 473 of the transfer roller side angular contact units 47 start to come into contact with the drive roller side angular contact members 322 at time T1 before the start of the separation of the elastic sheet 43. Then, when time T1 is elapsed, the concaved portion 41 starts to oppose the intermediate transfer belt 31.

The secondary transfer roller 4 rotates in a state in which the concaved portion 41 opposes the intermediate transfer belt 31, and the distal end of the gripper member 442 moves to the distal end of the gripper supporting member 441 and grips the recording medium RM at the same time or a bit later than the time when the secondary transfer roller 4 reaches a recording medium gripping position where the gripping portion 44 can grip the recording medium RM transported from the gate rollers 51 and 51. Then, the secondary transfer roller 4 rotates in the direction of rotation D4 while the gripping portion 44 grips the leading end of the recording medium RM. Then, when the secondary transfer roller 4 rotates a predetermined angle from the recording medium gripping position, the concaved portion 41 starts to be separated from the intermediate transfer belt 31, and the elastic sheet 43 comes into contact with the intermediate transfer belt 31 to form the nipping point NP. After time T2 has elapsed from the contact of the elastic sheet 43, the elastic members 473 of the transfer roller side angular contact units 47 start to be separated from the drive roller side angular contact members 322.

As described above, in this embodiment, the period in which the concaved portion 41 opposes the intermediate transfer belt 31 in the opposed period and the period in which the same does not oppose the intermediate transfer belt 31 in the non-opposed period are alternated, and the elastic sheet 43 comes into contact with the intermediate transfer belt 31 and the elastic members 473 of the angular contact units 47 come into contact with the drive roller 32 via the drive roller side angular contact member 322 at the time T1 when the non-opposed period is switched to the opposed period and for the time T2 when the opposed period is switched to the non-opposed period.

The overlapping mode is not limited thereto as a matter of course, and overlapping may be set to only when the non-opposed period is switched to the opposed period or, in contrast, only when the opposed period is switched to the non-opposed period. Overlapping is not a mandatory configuration of the invention, and a configuration of $$\alpha+\beta=360°$$

may be employed to perform the switching operation as follows. In other words, at the same time as the concaved portion 41 starts to be separated from the intermediate transfer belt 31 and the contact of the elastic sheet 43 with respect to the intermediate transfer belt 31 is started, the elastic members 473 of the angular contact units 47 are separated from the drive roller side angular contact member 322 (time T1=0). Also, at the same time as the concaved portion 41 starts to oppose the intermediate transfer belt 31 and the separation of the elastic sheet 43 from the intermediate transfer belt 31 is started, the elastic members 473 of the angular contact units 47 are brought into contact with the drive roller 32 (time T2=0) via the drive roller side angular contact members 322. In this embodiment, although the transfer roller side angular contact units 47 come into contact with the drive roller 32 via the drive roller side angular contact members 322, a configuration where the transfer roller side angular contact units 47 come into direct contact with the drive roller 32 is also applicable.

In the transfer device configured as described above, a transfer roller drive motor (not shown) is mechanically connected to the revolving shaft 421 of the secondary transfer roller 4. Also, a driver (not shown) is provided so as to drive the transfer roller drive motor, and the motor is driven according to the command given from the controller to drive the secondary transfer roller 4 to rotate clockwise in the paper plane of FIG. 1, that is, in a widthwise direction D4 with respect to the drive roller 32.

As described above, in this embodiment, the transfer device includes the secondary transfer roller 4, the pressing portion, and the angular contact units 47, and the image carried by the intermediate transfer belt 31 is secondarily transferred to the recording medium RM by the transfer device. In this transfer device, the elastic sheet 43 of the secondary transfer roller 4 is separated from the intermediate transfer belt 31 and hence the load applied to the intermediate transfer belt 31 is eliminated during the opposed period in which the concaved portion 41 opposes the intermediate transfer belt 31. However, the load is replaced by the elastic members 473 provided on the outer circumference of the angular contact units 47 coming into contact with the drive roller 32 for driving the intermediate transfer belt 31. Therefore, the difference between the load applied on the intermediate transfer belt 31 during the opposed period and the load applied on the intermediate transfer belt 31 during the non-opposed period may be restrained. In addition, since an impact at the time of switching between the opposed period and the non-opposed period is absorbed by elastic forces of the elastic members 473, vibrations in association with the switching may also be restrained. In this manner, according to this embodiment, the switching is achieved desirably while restraining the load variations, and by using the image forming apparatus provided with the transfer device, high-quality images can be formed.

In this embodiment, as shown in FIGS. 2A and 2B and FIGS. 3A to 3D, the width of the each angular contact unit 47 in the direction of axis of rotation X is significantly restrained in comparison with the width of the secondary transfer roller 4 in the same direction X, and hence downsizing of the device is achieved. However, in the device configured as described above, the contact area of the each elastic member 473 with respect to the drive roller 32 is dramatically smaller than the contact area of the elastic sheet 43 with respect to the intermediate transfer belt 31. Therefore, when the elastic members 473 and the elastic sheet 43 are formed of the same material, the load applied on the intermediate transfer belt 31 during the opposed period (the period when the transfer is not performed) is smaller than the load applied on the intermediate transfer belt 31 during the non-opposed period (the period when the transfer is performed). Therefore, in order to reduce the difference of the load, the following configuration is effective.

Here, in order to further reduce variations in the load applied to the intermediate transfer belt, for example, the material of the elastic members 473 is selected so that the hardness of the elastic members 473 exceeds the hardness of the elastic sheet 43. In the transfer device of this type, a rubber sheet or a resin sheet having a hardness of 40° to 60° according to Japanese Industrial Standards "JIS K 6253" is used as the elastic sheet 43 in many cases and, in this embodiment, a rubber sheet having a hardness of 60° is employed. Therefore, in this embodiment, the elastic members 473 are formed of an elastic material having a harness of 80° according to "JIS K 6253". Therefore, the pressure per unit area when the each elastic member 473 comes into contact with the drive roller side angular contact member 322 is larger than the pressure per unit area when the elastic sheet 43 comes into contact with the intermediate transfer belt 31. Consequently, the difference of the load is reduced, and the load variations can be restrained further effectively.

As detailed measures for reducing variations of the load, the elastic member 473 and the elastic sheet 43 can be configured so that the coefficient of friction of the elastic member 473 exceeds the coefficient of friction of the elastic sheet 43. In this configuration, the frictional force generated when the elastic member 473 comes into contact with the drive roller side angular contact member 322 exceeds the frictional force generated when the elastic sheet 43 comes into contact with the intermediate transfer belt 31. Consequently, the difference of the load is reduced, and the load variations can be restrained further effectively. For example, it is also possible to reduce the coefficient of friction by forming the front layer of the elastic sheet 43 of a material containing fluorine contained resin such as PTFE (polytetrafluoroethylene) mixed in urethane rubber, and on the other hand, to increase the coefficient of friction by forming the elastic members 473 of urethane rubber which is not mixed with fluorine contained resin. It is also possible to form the elastic members 473 of urethane rubber containing fluorine contained resin mixed therein as a matter of course and, in this case, the ratio of mixture of the fluorine contained resin in the elastic sheet 43 is preferably higher than that of the elastic members 473.

In addition, by forming the elastic members 473 with a larger thickness than the elastic sheet 43, the difference of the load is reduced in the same manner as the above-described embodiment, and the load variations can be restrained further effectively.

The invention is not limited to the embodiment described above, and various modifications may be made without departing the scope of the invention in addition to the configuration described above. For example, in the embodiment described above, the annular angular contact member 322 is fixed to the revolving shaft 321 of the drive roller 32 so as to allow the elastic members 473 of the transfer roller side angular contact units 47 to come into contact with the angular contact members 322. However, it is also possible to attach a bearing to the revolving shaft 321 instead of the angular contact members 322. In the embodiment configured in this manner, by selecting the material of the elastic members 473 so that the hardness of the elastic members 473 exceeds the hardness of the elastic sheet 43 or by configuring the elastic members 473 to have the thickness larger than that of the elastic sheet 43, the difference of the load becomes smaller in the same reason, so that the load variations can be restrained even more effectively.

Figure 5:
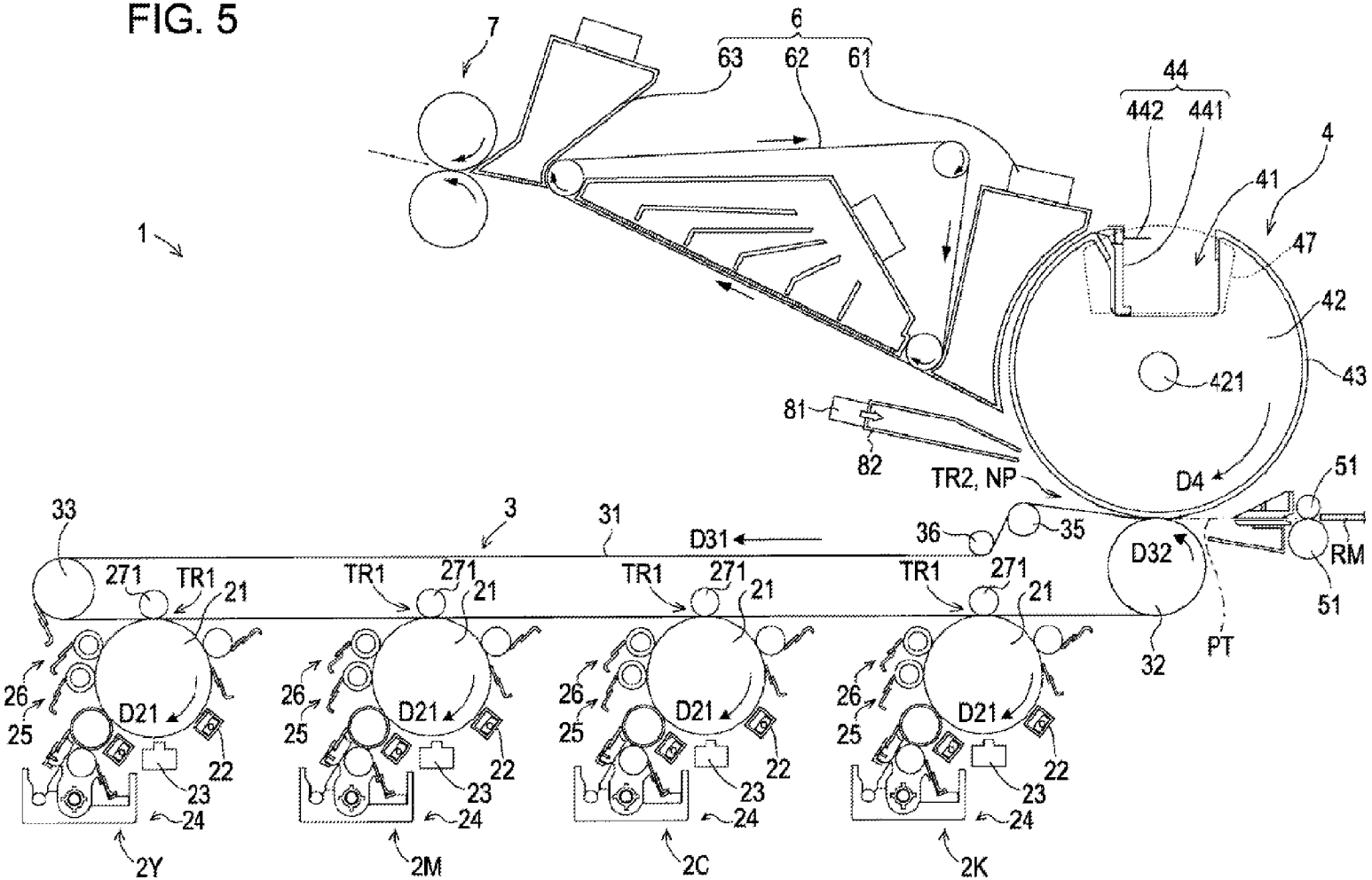
FIG. 5 is a drawing showing an image forming apparatus provided with another embodiment of a transfer device according to the invention.

The object of application of the invention is not limited to the above-described embodiment and, for example, the invention is also applicable to a transfer device configured to form a wound nipping point, as shown in FIG. 5, in order to transfer the image carried by the intermediate transfer belt 31 to the recording medium RM. Furthermore, this may be embodied in an image forming apparatus having such transfer device. In other words, in the embodiment shown in FIG. 5, the intermediate transfer belt 31 is wound around the drive roller 32, a first tension roller 33, a second tension roller 35, and a third tension roller 36, and is driven by the drive roller 32 to rotate in a state of being in contact with the photoconductor drum 21 at the primary transfer positions TR1 of the respective colors. Then, in the same manner as the embodiments describe above, toner images formed at the respective image forming stations 2Y, 2M, 2C, and 2K are transferred onto the intermediate transfer belt 31 by superimposing in sequence, so that a full color toner image is formed.

In the transfer device according to this embodiment, in the same manner as the embodiments described above, the secondary transfer roller 4 is arranged so as to oppose the drive roller 32 with the intermediary of the intermediate transfer belt 31, and the elastic sheet 43 opposes the intermediate transfer belt 31 to form the nipping point NP. At the secondary transfer position TR2 where the nipping point NP is formed, a single color or a plurality of colors of toner images carried by the intermediate transfer belt 31 are transferred to the recording medium RM transported from the pair of gate rollers 51 along the transporting path PT.

In the embodiments shown in FIG. 1 and FIG. 5, the invention is applied to the transfer device configured to transfer the image carried by the intermediate transfer belt 31 to the recording medium RM. However, the invention may be applied to the transfer device configured to transfer the image carried by a transfer drum to the recording medium RM as shown in FIG. 6 and the image forming apparatus having such transfer device.

Figure 6:
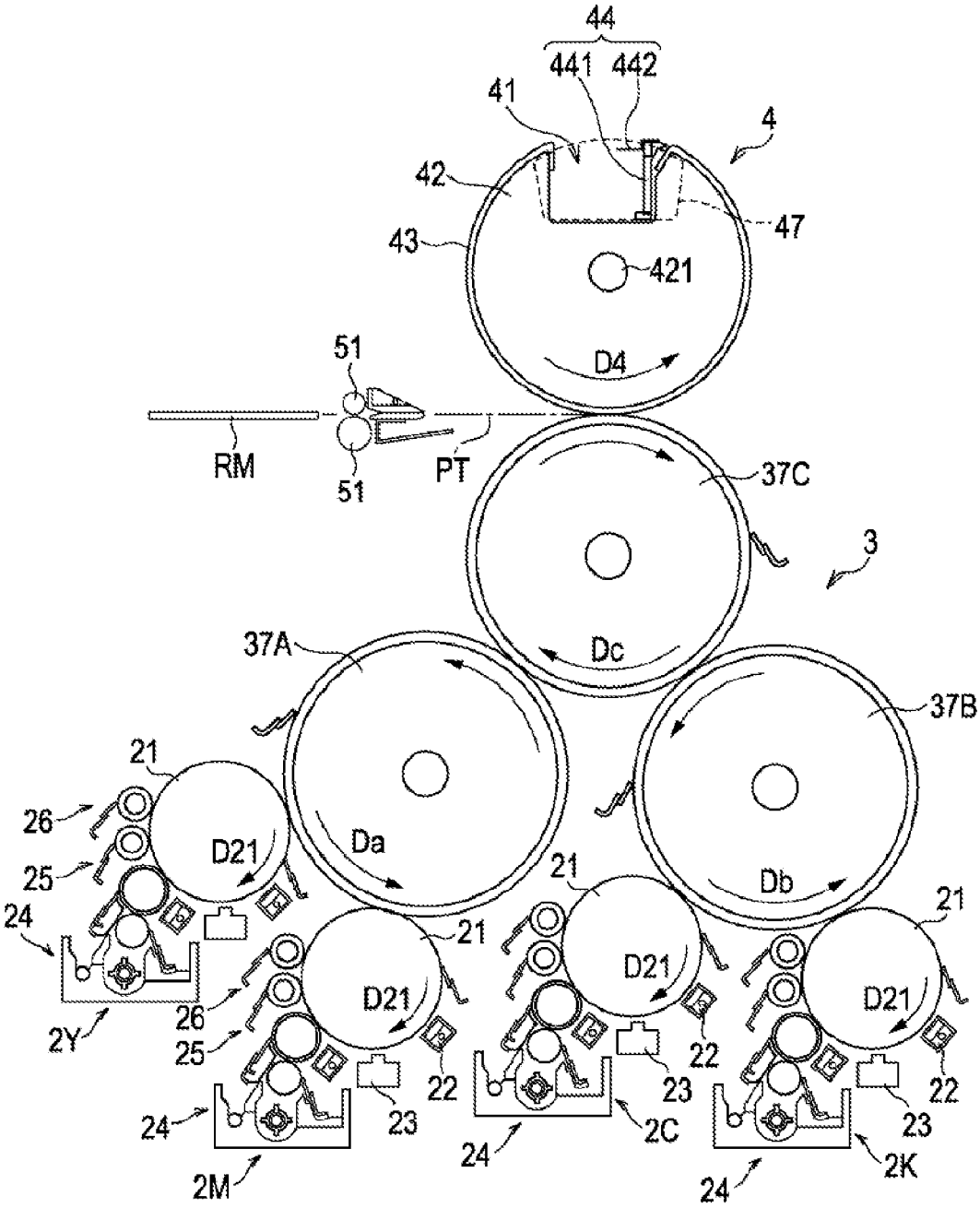
FIG. 6 is a drawing showing another embodiment of the image forming apparatus provided with the transfer device according to the invention.

FIG. 6 is a drawing showing another embodiment of the image forming apparatus provided with the transfer device according to the invention. In a image forming apparatus according to this embodiment, the transfer unit 3 includes three intermediate transfer drums 37A, 37B, and 37C. Among these intermediate transfer drums, the image forming stations 2Y and 2M are arranged in this order along a direction of rotation Da of the intermediate transfer drum 37A, and toner images formed in the respective image forming stations 2Y and 2M are transferred so as to be overlapped in sequence on the intermediate transfer drum 37A, so that a toner image of two colors, such as yellow and magenta, is formed. The intermediate transfer drum 37B is arranged apart from the intermediate transfer drum 37A in the horizontal direction (the lateral direction in FIG. 6). The image forming stations 2C and 2K are arranged in this order along a direction of rotation Db of the intermediate transfer drum 37B, and toner images formed in the respective image forming stations 2C and 2K are transferred so as to overlap in sequence on the intermediate drum 38B, so that a toner image of two colors, such as cyan and black, is formed. Furthermore, the remaining intermediate transfer drum 37C is arranged above the intermediate transfer drums 37A and 37B so as to be capable of coming into sliding contact with the respective outer circumferences, and two-color toner images carried by the respective intermediate transfer drums 37A and 37B are transferred onto the intermediate transfer drum 37C so as to be overlapped in sequence. Accordingly, a full color toner image is carried on the intermediate transfer drum 37C.

A transfer device having the same configuration as in the embodiments described above is arranged so as to oppose the intermediate transfer drum 37C. In other words, in this embodiment as well, the transfer device includes the secondary transfer roller 4, the pressing portion (not shown), and the angular contact units 47, and secondarily transfers the image carried by the intermediate transfer drum 37C to the recording medium RM. In this transfer device, the elastic sheet 43 of the secondary transfer roller 4 is separated from the intermediate transfer drum 37C and the load to the intermediate transfer drum 37C is eliminated during the opposed period in which the concaved portion 41 opposes the intermediate transfer drum 37C. The load is replaced by the elastic members 473 (see FIGS. 2A and 2B) provided on the outer circumferences of the angular contact units 47 coming into contact with the driving portion such as the revolving shaft of the intermediate transfer drum 37C or the like, which result in another load being applied on the intermediate transfer drum 37C. Therefore, the difference between the load applied on the intermediate transfer drum 37C during the opposed period and the load applied on the intermediate transfer drum 37C during the non-opposed period may be restrained. In addition, since an impact at the time of switching between the opposed period and the non-opposed period is absorbed by an elastic force of the elastic members 473, vibrations in association with the switching may also be restrained. In this manner, according to this embodiment, the switching is achieved desirably while restraining the load variations, and by using the image forming apparatus provided with the transfer device, high-quality images can be formed.

In addition, although the invention is applied to the transfer device configured to secondarily transfer the toner images carried by the intermediate transfer belt 31 or the intermediate transfer drum 37C to the recording medium RM as described above, the invention may be preferably applied to the transfer device configured to transfer the toner images formed on photoconductor members to a recording medium or an image forming apparatus provided with such transfer device.

What is claimed is:

1. A transfer device comprising:

an image carrier that carries an image;

a transfer roller including a roller base member opposing the image carrier, the transfer roller rotating about an axis of rotation, having a concaved portion on an outer circumference of the roller base member, and being configured to transfer the image carried by the image carrier to a recording medium when the concaved portion does not oppose the image carrier;

a pressing portion configured to press the transfer roller to the image carrier;

a supporting portion disposed on a drive transmitting portion configured to transmit a drive to the image carrier when the concaved portion opposes the image carrier; and a contact portion provided at an end of the roller base member in a direction of the axis of rotation at a position corresponding to the concaved portion, the contact portion including an outer circumference that comes into contact with the supporting portion, the outer circumference of the contact portion having an elastic member formed therein.

2. An image forming apparatus comprising:

an image forming portion configured to form an image;

an image carrier configured to carry the image formed by the image forming portion;

a driving portion configured to drive the image carrier;

a drive transmitting portion configured to transmit a drive from the driving portion to the image carrier;

a supporting portion disposed on the drive transmitting portion; and a transfer portion configured to transfer the image carried by the image carrier to a recording medium, wherein the transfer portion includes:

a transfer roller including a roller base member opposing the image carrier that rotates about an axis of rotation and having a concaved portion formed on an outer circumference thereof, the transfer roller being configured to transfer the image carried by the image carrier when the concaved portion does not oppose the image carrier;

a pressing portion configured to press the transfer roller to the image carrier; and a contact portion provided at an end of the roller base member in a direction of the axis of rotation at a position corresponding to the concaved portion, the contact portion including an outer circumference that contacts with the supporting portion, the outer circumference of the contact portion having an elastic member formed therein.

3. The image forming apparatus according to claim 2, wherein the transfer roller includes an elastic sheet disposed on the outer circumference of the roller base member, and that transfers the image carried by the image carrier to the recording medium by bringing the elastic sheet into contact with the image carrier via the recording medium, and wherein a contact area of the elastic member with respect to the supporting portion is smaller than a contact area of the elastic sheet with respect to the image carrier via the recording medium.

4. The image forming apparatus according to claim 3, wherein the hardness of the elastic member is higher than the hardness of the elastic sheet.

5. The image forming apparatus according to claim 3, wherein a coefficient of friction of the elastic member is larger than a coefficient of friction of the elastic sheet.

6. The image forming apparatus according to claim 3, wherein the thickness of the elastic member in the direction of a radius of the transfer roller is larger than the thickness of the elastic sheet in the direction of a radius of the transfer roller.

7. The image forming apparatus according to claim 2, wherein the contact of the contact portion with respect to the supporting portion is achieved before the concaved portion starts to oppose the image carrier.

8. The image forming apparatus according to claim 2, wherein the separation of the contact portion from the supporting portion is started after the separation of the concaved portion from the image carrier has started.

9. The image forming apparatus according to claim 2 wherein the image carrier is a transfer belt.

10. An image forming apparatus comprising:

an image forming portion configured to form an image;

an image carrier belt configured to carry the image formed by the image forming portion;

a driving roller configured to drive the image carrier belt;

a transfer portion configured to transfer the image carried by the image carrier belt to a recording medium, wherein the transfer portion includes:

a transfer roller including a roller base member opposing the image carrier belt that rotates about an axis of rotation and having a concaved portion formed on an outer circumference thereof, the transfer roller being configured to transfer the image carried by the image carrier belt when the concaved portion does not oppose the image carrier belt;

a pressing portion configured to press the transfer roller to the image carrier belt; and a contact portion provided at the end of the roller base member in a direction of the axis of rotation at a position corresponding to the concaved portion, the contact portion including an outer circumference that contacts with a supporting portion located on the driving roller, the outer circumference of the contact portion having an elastic member formed therein, wherein the elastic member of the contact portion contacts the supporting portion disposed on the driving roller that transmits the drive to the image carrier belt when the concaved portion opposes the image carrier belt so that a load from the contact portion contacting the support portion is substantially equal to a load from the image carrier belt contacting the transfer roller.

11. The image forming apparatus according to claim 10, wherein the transfer roller includes an elastic sheet disposed on the outer circumference of the roller base member, and which transfers the image carried by the image carrier belt to the recording medium by bringing the elastic sheet into contact with the image carrier belt via the recording medium, and wherein a contact area of the elastic member with respect to the supporting portion is smaller than a contact area of the elastic sheet with respect to the image carrier belt via the recording medium.

12. The image forming apparatus according to claim 11, wherein the hardness of the elastic member is higher than the hardness of the elastic sheet.

13. The image forming apparatus according to claim 11, wherein a coefficient of friction of the elastic member is larger than a coefficient of friction of the elastic sheet.

14. The image forming apparatus according to claim 11, wherein a thickness of the elastic member in a direction of a radius of the transfer roller is larger than a thickness of the elastic sheet in the direction of a radius of the transfer roller.

15. The image forming apparatus according to claim 10, wherein the contact of the contact portion with respect to the supporting portion is achieved before the concaved portion starts to oppose the image carrier belt.

16. The image forming apparatus according to claim 10, wherein a separation of the contact portion from the supporting portion is started after a separation of the concaved portion from the image carrier belt has started.

* * * * *